US012668288B2

(12) United States Patent
Oda et al.

(10) Patent No.: US 12,668,288 B2
(45) Date of Patent: Jun. 30, 2026

(54) OBSTACLE DETECTION SYSTEM USING MULTIPLE PROCESSORS

(71) Applicant: Hitachi, Ltd., Tokyo (JP)

(72) Inventors: Atsushi Oda, Tokyo (JP); Jun Koike, Tokyo (JP); Keiichi Katsuta, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 471 days.

(21) Appl. No.: 18/248,712

(22) PCT Filed: Oct. 8, 2021

(86) PCT No.: PCT/JP2021/037324
§ 371 (c)(1),
(2) Date: Apr. 12, 2023

(87) PCT Pub. No.: WO2022/080251
PCT Pub. Date: Apr. 21, 2022

(65) Prior Publication Data

US 2023/0391385 A1 Dec. 7, 2023

(30) Foreign Application Priority Data

Oct. 13, 2020 (JP) ..... 2020-172289

(51) Int. Cl.
*B61L 25/02* (2006.01)
*B61L 23/04* (2006.01)
*B61L 25/00* (2006.01)

(52) U.S. Cl.
CPC ..... *B61L 25/02* (2013.01); *B61L 23/041* (2013.01); *B61L 23/04* (2013.01)

(58) Field of Classification Search
CPC ..... B61L 25/02; B61L 23/041; B61L 25/025; B61L 15/0062; B61L 15/0027;
(Continued)

(56) References Cited

U.S. PATENT DOCUMENTS 10,262,234 B2 * 4/2019 Li ..... G06V 20/56
11,668,070 B2 * 6/2023 Ready-Campbell ..... G05D 1/0231 701/50

(Continued)

FOREIGN PATENT DOCUMENTS

CN 110329316 A 10/2019
EP 2 966 576 A1 1/2016

(Continued)

OTHER PUBLICATIONS

Indian Office Action issued in corresponding IN Patent Application No. 202317030110, dated Aug. 13, 2024 (6 pages).

(Continued)

*Primary Examiner* — Justin R Knapp
(74) *Attorney, Agent, or Firm* — Foley & Lardner LLP

(57) ABSTRACT

An object of the invention is to reduce a calculation performance required for an obstacle detection device while maintaining an obstacle detection range in a wide range in an obstacle detection system where external sensor data mounted in a track transport system is used. Therefore, in the invention, an obstacle detection system includes: an external sensor configured to monitor surroundings of a train; and at least two or more obstacle detection processing units configured to perform obstacle detection processing for detecting an obstacle by using sensor data acquired by the external sensor, in which the obstacle detection processing is distributed to the two or more obstacle detection processing units according to sensor information of the sensor data.

16 Claims, 4 Drawing Sheets

(58) Field of Classification Search
CPC ..... B61L 23/16; B61L 23/14; B61L 27/04; B61L 23/047; B61L 27/70; B61L 27/20; B61L 25/021; B61L 2205/04; B61L 15/0054; B61L 2201/00; B61L 15/0072; G01S 13/865; G01S 2013/93271; G01S 15/931; G01S 13/60; G01S 13/862; G01S 13/867; G01S 17/931; G01S 2013/9328; G01S 17/86
See application file for complete search history.

(56) References Cited

U.S. PATENT DOCUMENTS

| | | | | |
|---|---|---|---|---|
| 2016/0046308 | A1* | 2/2016 | Chung | B61L 27/04 701/20 |
| 2021/0046959 | A1 | 2/2021 | Ueda et al. | |
| 2023/0249723 | A1* | 8/2023 | Tomida | B61L 23/00 246/182 A |
| 2024/0043043 | A1* | 2/2024 | Brooks | B60W 60/00256 |

FOREIGN PATENT DOCUMENTS

| | | | |
|---|---|---|---|
| EP | 3 138 753 | A1 | 3/2017 |
| EP | 3 466 793 | A1 | 4/2019 |
| EP | 3 492 306 | A1 | 6/2019 |
| EP | 3 569 471 | A1 | 11/2019 |
| EP | 3 705 371 | A1 | 9/2020 |
| JP | 2019-084881 | A | 6/2019 |
| WO | WO-2018/020928 | A1 | 1/2018 |
| WO | WO-2019/155569 | A1 | 8/2019 |
| WO | WO-2019/244425 | A1 | 12/2019 |

OTHER PUBLICATIONS

International Search Report with English Translation and Written Opinion of International Patent Application No. PCT/JP2021/037324 dated Nov. 22, 2021 (9 pages).
Extended European Search Report issued in corresponding EP Application No. 21879990.6, dated Oct. 21, 2024 (12 pages).

* cited by examiner

OBSTACLE DETECTION SYSTEM USING MULTIPLE PROCESSORS

TECHNICAL FIELD

The present invention relates to an obstacle detection device mounted in a track transport system that travels on a track.

BACKGROUND ART

In recent years, a study for autonomous driving in an existing track transport system is performed for reasons such as a concern about a shortfall in human resources due to aging of a driver and a reduction in an operation cost. In a track transport system in which a transport vehicle travels on a track, avoidance cannot be implemented by steering when there is an obstacle on the track, and thus it is important to detect the obstacle on the track for improving safety and operability of the track transport system. At present, the driver visually detects an obstacle on a track and on a path. Meanwhile, a mechanism for automatically detecting the obstacle on the path is required to perform unmanned driving, and a method using an external sensor such as a millimeter-wave radar, a laser radar, and a camera is studied. PTL 1 discloses a technique of detecting an obstacle on a track by an external sensor.

CITATION LIST

Patent Literature

PTL 1: WO2019/155569

SUMMARY OF INVENTION

Technical Problem

In processing of detecting an obstacle based on external sensor data, in particular, when an image is used, advanced image processing is required, and a calculation load is increased. As a result, a high-performance calculation device has to be used, and a cost of an obstacle detection device is increased. In the technique described in PTL 1, by limiting a range in which obstacle detection using the external sensor is performed according to a position of a train, the calculation load of the obstacle detection processing is reduced. However, since the obstacle detection is required in a wide range at a railroad crossing, a platform, or the like, processing with a high calculation load has to be performed at the railroad crossing or the platform. In order to maintain a real time performance of the obstacle detection processing in these sections, a calculation performance of the obstacle detection device has finally to be set to satisfy the calculation load at the position of the train at which the calculation load is high. Therefore, a high-performance device has to be used in the obstacle detection device. In order to solve the above problem, an object of the invention is to reduce a calculation performance required for an obstacle detection device while maintaining an obstacle detection range in a wide range in an obstacle detection system where external sensor data mounted in a track transport system is used.

Solution to Problem

In order to solve the above problem, an obstacle detection system includes: an external sensor configured to monitor surroundings of a train; and at least two or more obstacle detection processing units configured to perform obstacle detection processing for detecting an obstacle by using sensor data acquired by the external sensor, in which the obstacle detection processing is distributed to the two or more obstacle detection processing units according to sensor information of the sensor data.

Advantageous Effects of Invention

According to the invention, it is possible to reduce a calculation performance required for an obstacle detection device while maintaining an obstacle detection range in a wide range in an obstacle detection system where external sensor data mounted in a track transport system is used. Problems, configurations, and effects other than those described above will be clarified by the following description of embodiments.

DESCRIPTION OF EMBODIMENTS

Embodiments of the invention will be described below with reference to the drawings.

Embodiment 1

Figure 1:
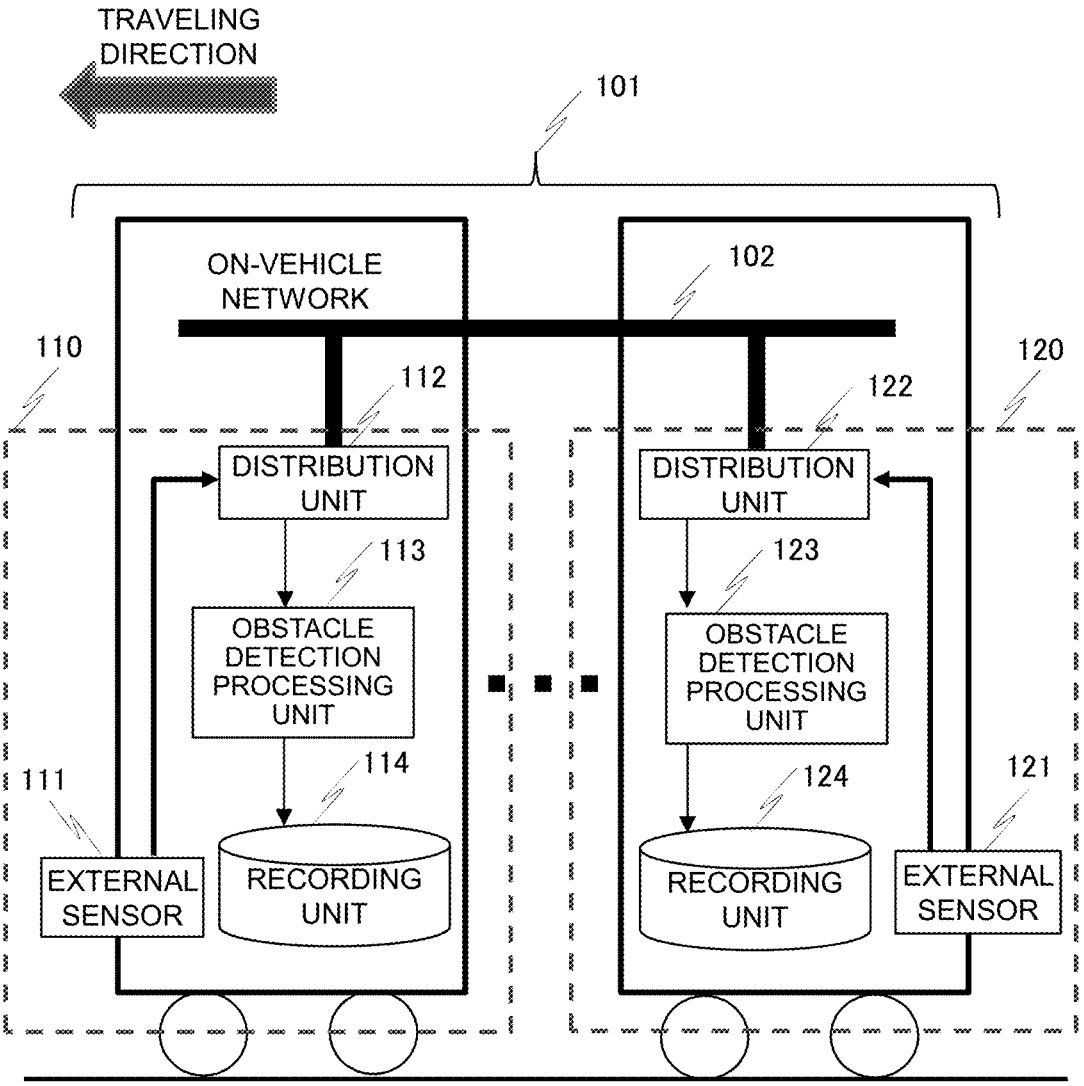
FIG. 1 is a diagram showing a system configuration according to Embodiment 1 of the invention.

FIG. 1 is a diagram showing a system configuration of an obstacle detection system according to Embodiment 1. An obstacle detection system 110 is mounted in a train 101 and includes an external sensor 111, a distribution unit 112, an obstacle detection processing unit 113, and a recording unit 114. The obstacle detection system 110 is connected to an on-vehicle network 102. The train 101 is provided with a cab. When the train 101 is a single-car train, the cab is provided on both sides of the car, and when the train 101 includes a plurality of cars, the cab is provided in a lead car and a tail car of the train. That is, at least two cabs are provided in the train 101. The obstacle detection system is mounted in each cab. The first obstacle detection system 110 mounted in the lead car and a second obstacle detection system 120 mounted in the tail car are connected through the on-vehicle network 102. In the present embodiment, a description will be given when the train includes a plurality of cars and when a stereo camera and a light detection and ranging (LIDAR) are mounted as the external sensors.

The external sensor 111 senses a state of surroundings (in particular, the front) of the train, and transmits sensing data to the distribution unit 112. Examples of the external sensor 111 include a camera, a laser range finder such as a LIDAR, and a millimeter-wave radar. Examples of the camera include a monocular camera, a stereo camera, and an infrared camera. A plurality of sensors are generally mounted for redundancy. When the train 101 travels in a traveling direction, the external sensor 111 of the first obstacle detection system 110 mounted in the lead car on a traveling direction side is used.

The distribution unit 112 determines whether to transmit data from the external sensor 111 to the obstacle detection processing unit 113 of the first obstacle detection system 110 in the lead car or to transmit the data to the second obstacle detection system 120 in the tail car through the on-vehicle network 102. The data of the external sensor 111 determined to be transmitted to the first obstacle detection system 110 is transmitted to the obstacle detection processing unit 113, and the data of the external sensor 111 determined to be transmitted to the second obstacle detection system 120 in the tail car is transmitted to the on-vehicle network 102.

Obstacle detection processing units 113 and 123 grip a situation in front of the train by using external sensor data from the distribution units 112 and 122, and determine presence or absence of an obstacle. In processing of the obstacle detection processing units 113 and 123, a technique used in an automobile field can be used. For example, there is a method of creating a parallax image by using a stereo camera and recognizing a shape and a position of an object in front based on the parallax image. There is also a method of recognizing an object on an image by using a deep neural network (DNN) based on a monocular image, or a method of recognizing an object based on point group data of a LIDAR. At this time, the DNN is one of means used for machine learning, and recognizes and detects various objects by extracting and learning a feature of the object. In the invention, the method is not limited as long as the method can recognize an obstacle or an object.

The recording unit 114 records an obstacle detection result and the external sensor data such as information on the object in an external environment recognized by the first obstacle detection system 110 and the second obstacle detection system 120 and a determination result. The external sensor data may be received from the obstacle detection processing unit 113 or may be received from the distribution unit 112 and the external sensor 111. The recorded external sensor data and obstacle detection result are transferred to a ground server and the like at a rail yard and the like. The external sensor data and the obstacle detection result transferred to the ground are used to improve a processing accuracy of the obstacle detection processing or used to check a situation when an accident occurs.

Recording may be shared by a recording unit 124. In this case, the recording unit 114 records the obstacle detection result and the external sensor data such as the information on the object in the external environment recognized by the first obstacle detection system 110 and the determination result. The recording unit 124 records the obstacle detection result and the external sensor data such as the information on the object in the external environment recognized by the second obstacle detection system 120 and the determination result. The external sensor data may be received from the obstacle detection processing units 113 and 123, or may be received from the distribution units 112 and 122 and the external sensor 111. In this way, by distributing and recording the obstacle detection result and the external sensor data acquired by processing in an obstacle detection system by a recording unit provided in the corresponding obstacle detection system, it is possible to reduce a storage capacity required for one recording unit.

That is, the obstacle detection result and the external sensor data, such as the information on the object in the external environment recognized by the first obstacle detection system 110 and the second obstacle detection system 120 and the determination result, may be recorded only in the recording unit 114 of the first obstacle detection system 110, only in the recording unit 124 of the second obstacle detection system 120, or in both of the recording unit 114 and the recording unit 124 according to the storage capacity of each recording unit. In short, a recording unit is not limited as long as the obstacle detection result and the external sensor data are recorded.

Figure 2:
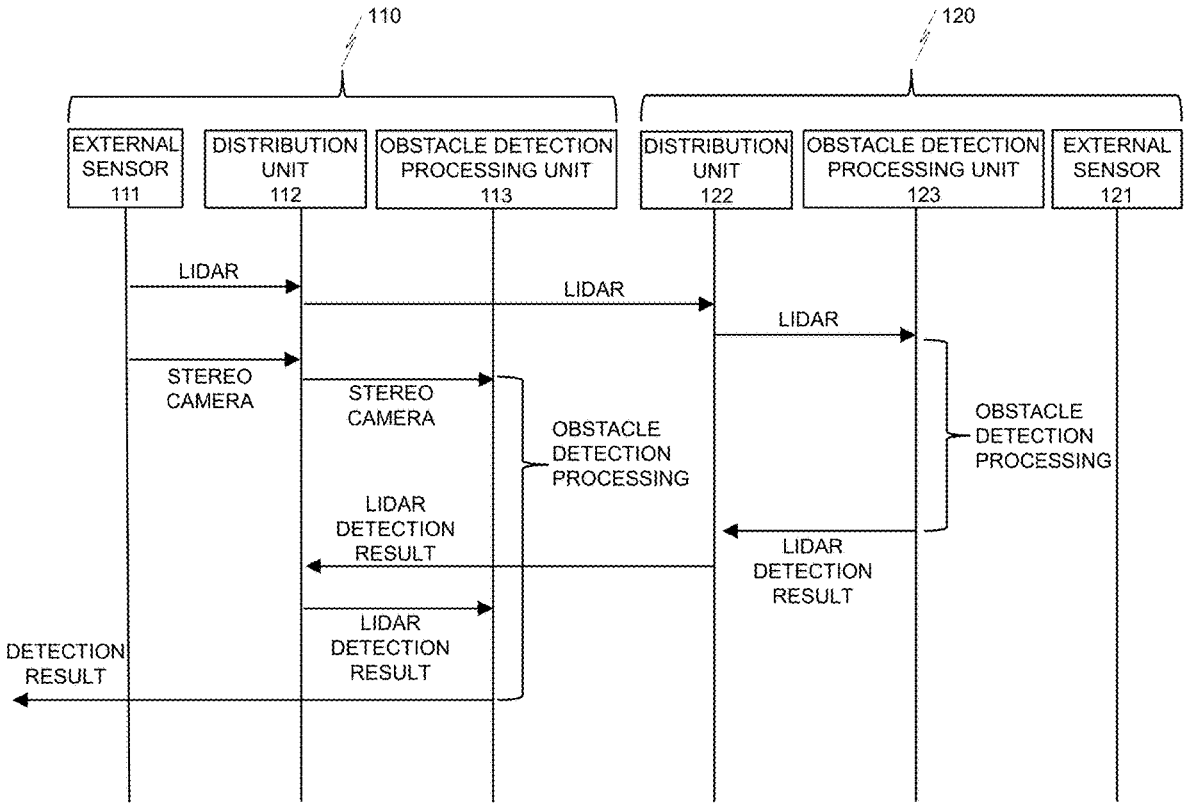
FIG. 2 is a diagram showing a flow of data processing according to Embodiment 1 of the invention.

Next, with reference to FIG. 2, a flow of the obstacle detection processing and a flow of the external sensor data according to Embodiment 1 of the invention will be described. FIG. 2 shows a case in which a stereo camera and a LIDAR are used as the external sensors. The external sensor 111 of the first obstacle detection system 110 transmits the external sensor data at a predetermined data acquisition cycle. The external sensor data is transmitted from the external sensor 111 to the distribution unit 112 of the first obstacle detection system 110. The distribution unit 112 determines a transmission destination of the external sensor data according to a predetermined distribution method. The distribution method will be described later.

In the case in FIG. 2, stereo camera data is transmitted to the obstacle detection processing unit 113 of the first obstacle detection system 110, and LIDAR data is transmitted to the second obstacle detection system 120. The obstacle detection processing unit 113 of the first obstacle detection system 110 recognizes the obstacle in front of the train by using the stereo camera data.

The LIDAR data transmitted to the second obstacle detection system 120 is transmitted to the obstacle detection processing unit 123 of the second obstacle detection system 120 via the distribution unit 122 of the second obstacle detection system 120. The obstacle detection processing unit 123 of the second obstacle detection system 120 recognizes the obstacle in front of the train by using the LIDAR data. The obstacle detection processing unit 123 of the second obstacle detection system 120 transmits an obstacle detection result (the presence or absence of the obstacle, a position of the obstacle, and a type of the obstacle) to the distribution unit 112 of the first obstacle detection system 110 in the lead car.

The distribution unit 112 of the first obstacle detection system 110 receives the obstacle detection result of the LIDAR transmitted from the second obstacle detection system 120, and then transmits the received obstacle detection result of the LIDAR to the obstacle detection processing unit 113 of the first obstacle detection system 110. The obstacle detection processing unit 113 of the first obstacle detection system 110 integrates an obstacle detection result recognized from the stereo camera data and the obstacle detection result of the LIDAR received from the second obstacle detection system 120 via the distribution unit 112, and calculates a final obstacle detection result.

The present embodiment describes an example in which the distribution unit 112 of the first obstacle detection system 110 receives the obstacle detection result transmitted from the second obstacle detection system 120 and then transmits the obstacle detection result to the obstacle detection processing unit 113 of the first obstacle detection system 110. At this time, the distribution unit 112 of the first obstacle detection system 110 may be provided with a transfer unit that plays a role of transferring the obstacle detection result transmitted from the second obstacle detection system 120 to the obstacle detection processing unit 113 of the first obstacle detection system 110 regardless of whether to perform logical processing on the obstacle detection result to be transmitted and received. The second obstacle detection system 120 may directly transmit the obstacle detection result to the obstacle detection processing unit 113 of the first obstacle detection system 110 without passing through the distribution unit 112 of the first obstacle detection system 110.

The obstacle detection processing unit 113 of the first obstacle detection system 110 notifies a crewman of the final obstacle detection result through a human machine interface (HMI) (not shown), or transmits the final obstacle detection result to another device in the train through the on-vehicle network. In the invention, a format of the obstacle detection result and a method of using the obstacle detection result are not limited.

Next, the processing of the distribution unit according to Embodiment 1 of the invention will be described with reference to FIG. 3.

Figure 3:
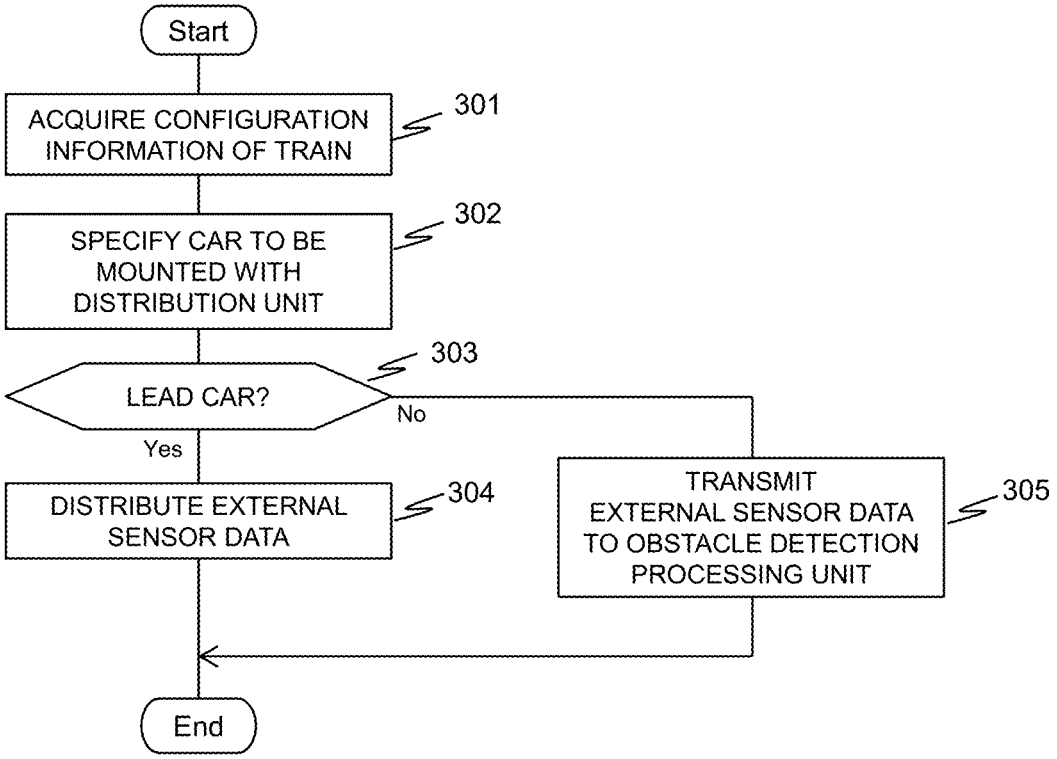
FIG. 3 is a flowchart showing processing of a distribution unit according to an embodiment of the invention.

FIG. 3 is a flowchart showing processing executed by each distribution unit.

Step 301

The distribution unit acquires configuration information of the train from a car information control device that manages information on the car. The configuration of the train includes the number of cars, the presence or absence of connection of the cars, and the like. The distribution unit recognizes the number of obstacle detection systems present in the train based on the configuration information of the train.

The number of the obstacle detection systems may be recognized by a method other than a method of gripping the information from the car information control device. For example, the method may be a method of inputting the number of the obstacle detection systems in the train by the crewman through the HMI, or a method of gripping the number of the obstacle detection systems in the train by the obstacle detection systems exchanging the information through the on-vehicle network.

When the griped number of the obstacle detection systems is less than 2, a calculation resource necessary for performing predetermined obstacle detection processing may be insufficient. In this case, the crewman may be notified, through the HMI, of a fact that the obstacle detection processing may not be correctly executed. Alternatively, the obstacle detection processing may be executed while a function is limited. For example, obstacle detection by image processing may not be performed, and only the obstacle detection processing by using the LIDAR data may be performed. In addition, the crewman may be notified, through the HMI, of a fact that a function that can be used is limited.

Step 302

A car in which each distribution unit is to be mounted is specified. The specifying of the car to be mounted with a distribution unit is that the distribution unit itself recognizes whether the distribution unit is to be mounted in the lead car on the traveling direction side of the train or to be mounted in a tail car side. Each distribution unit acquires the traveling direction from the car information control device that manages the information on the car, and determines whether the distribution unit itself is a distribution unit to be mounted in the lead car or a distribution unit to be mounted in the tail car.

The specifying of the car to be mounted with a distribution unit may be performed by a method other than the method performed based on the information of the car information control device. For example, the method may be a method of inputting the traveling direction by the crewman through the HMI, or a method of performing determination based on information of a train line (a line 4, a line 5, and the like) indicating the traveling direction and a number of the car to be mounted with a distribution unit. In addition, the method may be a method in which a power supply is supplied only to the distribution unit in the lead car, or a method in which a specific signal is input only to the distribution unit in the lead car. In short, the method is not limited in the invention as long as it is known whether the distribution unit itself is to be mounted in the lead car.

When a plurality of trains are connected to constitute one, a last tail car of a train including a lead car is set as a tail car. That is, when three two-car trains are connected to constitute a six-car train, and a lead car is a car No. 1 and a last car is a car No. 6, a distribution unit in a car No. 2 is a distribution unit in the tail car. In this way, transmission delay related to communication between the cars can be minimized, and a time for the obstacle detection processing can be secured as much as possible.

Step 303

It is determined whether the distribution unit is the distribution unit in the lead car. When the distribution unit is the distribution unit in the lead car, the processing proceeds to step 304, and when the distribution unit is the distribution unit in the tail car, the processing proceeds to step 305.

Step 304

The distribution unit 112 in the first obstacle detection system 110 in the lead car acquires the external sensor data from the external sensor 111, and determines, according to the data type, whether to transmit the external sensor data to the obstacle detection processing unit 113 of the first obstacle detection system 110 in the lead car or to transmit the external sensor data to the second obstacle detection system 120 in the tail car.

Specifically, the external sensor data having a small volume of the external sensor data is transmitted to the second obstacle detection system 120 in the tail car. In this way, it is possible to prevent the transmission delay when the external sensor data is transmitted to the second obstacle detection system 120 without compressing a band of the on-vehicle network 102. Processing with a short processing time in the obstacle detection processing unit may be transmitted to the second obstacle detection system 120 in the tail car.

When the obstacle detection processing of the first obstacle detection system 110 in the lead car operates at a constant period (for example, 200 ms), an obstacle detection processing result of the second obstacle detection system 120 in the tail car needs to return to the lead car within this operation cycle. At this time, since a time to transfer the external sensor data and the obstacle detection processing result is required, a processing time available for the obstacle detection processing by the obstacle detection processing unit 123 of the second obstacle detection system 120 in the tail car is shorter than a processing time in the obstacle detection processing unit 113 in the lead car. Therefore, it is desirable that the processing with a short processing time in the obstacle detection processing unit is performed as much as possible by the obstacle detection processing unit 123 of the second obstacle detection system 120 in the tail car. A distribution rule may be a rule recorded in advance in a nonvolatile memory, or may be set by the crewman through the HMI. The distribution unit plays a role of switching, depending on the traveling direction, a car that executes the obstacle detection processing of the external sensor data having a small data volume or a small processing load.

That is, the obstacle detection system according to the invention is characterized in that an execution location of the obstacle detection processing using the sensor data of the external sensor distributed to the obstacle detection processing unit mounted in a car other than the lead car in the traveling direction is switched to the obstacle detection processing unit in the lead car according to a change in the traveling direction of the train. In the present embodiment, detection processing of external sensor data having a large data volume or a large processing load is executed by the lead car or a car in which an external sensor in operation is mounted, detection processing of external sensor data having a small data volume or a small processing load is executed in a car other than the lead car or the car in which the external sensor in operation is mounted, and the execution location is switched according to the traveling direction of the train.

Step 305

The distribution unit 122 of the second obstacle detection system 120 in the tail car transmits the external sensor data received through the on-vehicle network 102 to the obstacle detection processing unit 123 of the second obstacle detection system 120 in the tail car.

The present embodiment describes an example in which two cabs are present in the train and two obstacle detection systems are present in the train. When a plurality of trains are connected together to constitute one, three or more cabs are present in the train, and three or more obstacle detection systems are present in the train. In this case, any two obstacle detection systems may be selected from at least three or more obstacle detection systems in the train to execute the obstacle detection processing. It is desirable that a first obstacle detection system is an obstacle detection system mounted in the lead car, and a second obstacle detection system is an obstacle detection system mounted in a car close to the lead car and having the cab. In order to further reduce the processing load, three or more obstacle detection systems may be selected from the at least three or more obstacle detection systems in the train to execute the obstacle detection processing.

In the distribution rule of the present embodiment, it is assumed that the obstacle detection processing of the external sensor data in which the volume of the external sensor data is small or the obstacle detection processing of the external sensor data in which the processing time in the obstacle detection processing unit is short is transmitted to the second obstacle detection system, but the distribution rule may be changed according to the external environment. For example, since a detection performance of the camera decreases in nighttime, rain, and a tunnel, it is conceivable to perform the obstacle detection processing of the LIDAR resistant to the nighttime or the rain on both sides of the lead car.

It is also possible to assume a case in which distribution is performed for each region to be captured by the external sensor. For example, the external sensor data capturing a dangerous region, in which the traveling of the train is hindered when the obstacle is present, such as a track region, may be set to be transmitted to the obstacle detection processing unit on both sides of the lead car in which noise due to transmission and reception of the data is difficult to mix, and processing on a peripheral region in which a degree-of-danger is low and importance of the obstacle detection is not higher than that on the track may be set to be transmitted to the tail car.

Further, it is also conceivable that the obstacle detection processing of the external sensor having an early data acquisition cycle and a short obstacle detection processing is performed on both sides of the lead car where transmission is not required. In the present embodiment, it is assumed that all the processing is performed at 200 ms, sensor data can also be input in a short cycle. Such obstacle detection processing for the external sensor data having an early data acquisition cycle is executed in a short cycle on the lead car side. As an example, there is a case in which the detection processing unit of the lead car operates at 50 ms, and the detection processing unit at the tail car side operates at 200 ms.

According to the present embodiment, a part of the obstacle detection processing can be performed by the obstacle detection processing unit in the tail car which has not been used in the related art. When the obstacle detection processing is performed only by the obstacle detection system in the lead car, a calculation device having a performance capable of withstanding detection processing loads of the stereo camera and the LIDAR is required for each obstacle detection system. On the other hand, in the obstacle detection system according to the invention, a performance of the calculation device can be reduced and a cost can be reduced as long as the obstacle detection processing unit in the lead car has the performance capable of withstanding the detection processing of the stereo camera. An effect of reducing the performance of the calculation device is also exhibited in addition to a combination of the stereo camera and the LIDAR. In particular, when the number of the external sensors is large, an effect of reducing the load of the calculation device according to the invention is remarkable.

Embodiment 2

Figure 4:
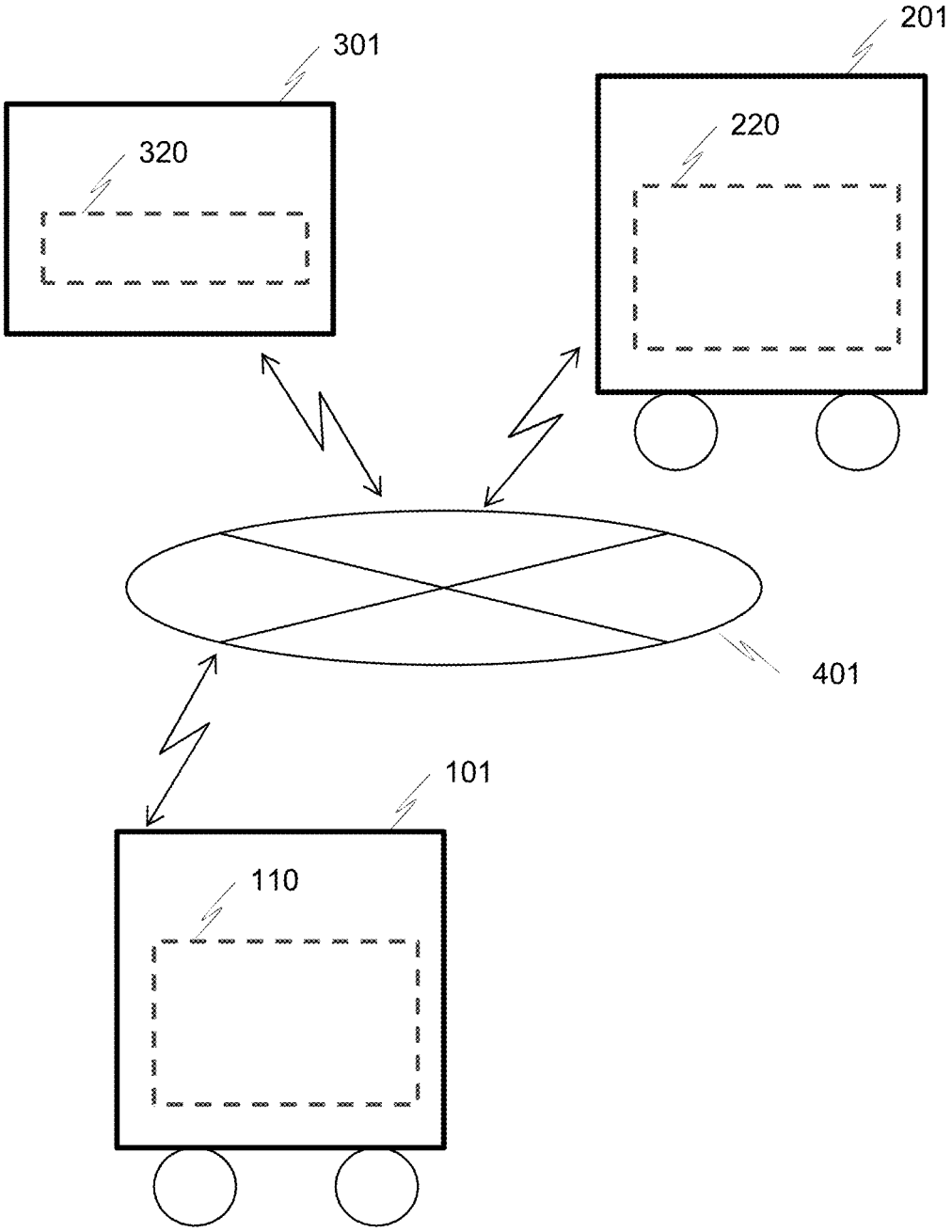
FIG. 4 is a diagram showing a system configuration according to Embodiment 2 of the invention.

FIG. 4 is a diagram showing a system configuration of an obstacle detection system according to Embodiment 2. In Embodiment 1, two obstacle detection systems are present in the same train, whereas the present embodiment describes an example in which a first obstacle detection system is present in a lead car and a third obstacle detection system serving as a second obstacle detection system that shares obstacle detection processing is present on ground or in another train.

Obstacle detection systems 110 and 220 are respectively mounted in trains 101 and 201, and each includes an external sensor, an obstacle detection processing unit, a recording unit, and a distribution unit. The obstacle detection systems 110 and 220 are connected to an on-vehicle network in each train. The on-vehicle network is connected to a ground portion 301 through ground-vehicle communication 401. The ground portion 301 is connected to a plurality of trains 101 and 201 through the ground-vehicle communication 401. Therefore, the train is connected to the other train through the ground. The present embodiment describes an example in which the trains are connected to each other through the ground portion, but the trains may directly communicate with each other and may be connected to each other.

FIG. 4 illustrates a case in which the obstacle detection processing of the obstacle detection system 110 of the train 101 is shared. The distribution unit 112 of the first obstacle detection system 110 in the train 101 determines which of an obstacle detection system 320 in the ground portion 301 and the obstacle detection system 220 in the other train 201 is to be the third obstacle detection system. The third obstacle detection system may be defined in advance or may be defined according to a current situation. Alternatively, a location of the third obstacle detection system may be selected by a crewman through an HMI.

The distribution unit 112 of the first obstacle detection system 110 distributes external sensor data having a small data volume or external sensor data of an external sensor having a short obstacle detection processing time among external sensor data from the external sensor 111 to the third obstacle detection system 220 or 320 through the ground-vehicle communication 401.

Since it is necessary to transfer the external sensor data, it is desirable that the obstacle detection systems in the same train can be set as the first obstacle detection system 110 and the third obstacle detection system sharing the obstacle detection processing. When the obstacle detection systems in the same train do not operate due to a failure, according to the present embodiment, the obstacle detection system on the ground or in the other train can be set as the third obstacle detection system. When the obstacle detection system on the ground or in the other train is set as the third obstacle detection system, it is desirable that the third obstacle detection system is an obstacle detection system in which a communication path is as short as possible among the obstacle detection systems capable of communicating with the train in which the first obstacle detection system 110 is mounted through the ground-vehicle communication. At this time, since the obstacle detection processing of the first obstacle detection system operates at a constant period, the third obstacle detection system needs to be present in a communication path in which at least an obstacle detection processing result can be returned to the first obstacle detection system within a constant operation cycle. It is also desirable that the obstacle detection system mounted in the train that is stopped is preferentially set as the third obstacle detection system. The train that is stopped in this case is assumed to be a train that is stopped at a rail yard or a train that is stopped at a station. In this way, it is possible to avoid affecting the distributed obstacle detection processing of the train itself as the third obstacle detection system.

In the present embodiment, the third obstacle detection system is the obstacle detection system on the ground or in the other train, but the first obstacle detection system may be the obstacle detection system on the ground or in the other train. At least two obstacle detection systems may be selected from a plurality of obstacle detection systems on the ground or in the train, obstacle detection processing may be performed in the selected obstacle detection system, and a selection method and a location of the obstacle detection system are not limited.

Embodiment 3

Next, an example will be described in which a plurality of trains are connected to constitute one. Basically, even though a plurality of trains are connected, a detection processing load of an external sensor that monitors the front does not change. Therefore, detection processing of the external sensor related to monitoring the front is the same as in Embodiments 1 and 2, and thus the description thereof will be omitted.

A plurality of side monitoring external sensors are generally attached to each car. The side monitoring external sensors are attached to sides of a train and perform monitoring of a person on a platform, falling of a person between the train and the platform, detection of pinching of a passenger by a train door, and the like. Therefore, when a plurality of trains are connected to constitute one, the number of the side monitoring external sensors increases according to the number of the connected trains, and as a result, a detection processing load of the side monitoring external sensor also increases.

When the detection processing of the side monitoring external sensors is executed only in an obstacle detection system in a lead car and an obstacle detection system in a tail car, the processing load varies depending on the number of connected trains. When the number of connection is large, a detection processing time may not be sufficient. Therefore, a distribution unit in each car does not transmit external sensor data of the external sensor whose processing load varies depending on the number of connection to another obstacle detection system. In this way, it is possible to avoid an event in which a detection processing time using the external sensor data is not sufficient.

The above embodiments describe a configuration in which the external sensor data is taken into the distribution unit in the lead car at one time and distributed to each obstacle detection processing unit, but another configuration may be used. Specifically, external sensor data of an external sensor having a large sensor data volume or a long obstacle detection processing time, such as a stereo camera, may be directly input to the obstacle detection processing unit in the lead car without passing through the distribution unit, and external sensor data of an external sensor having a small external sensor data volume or a short obstacle detection processing time may be input to the obstacle detection processing unit in the tail car through the on-vehicle network. In this way, the distribution unit is no longer necessary. In addition, it is possible to reduce a transmission time to pass through the distribution unit, and it is possible to increase a time for the obstacle detection processing.

According to the embodiments described above, it is possible to reduce a calculation performance required for an obstacle detection device while maintaining an obstacle detection range in a wide range in an obstacle detection system where external sensor data mounted in a track transport system is used.

The embodiments of the invention are described above, but the invention is not limited to the embodiments described above, and various modifications can be made without departing from the scope of the invention.

REFERENCE SIGNS LIST

101: train
102: on-vehicle network in train 101
110: first obstacle detection system mounted in lead car
111: external sensor of first obstacle detection system mounted in lead car
112: distribution unit of first obstacle detection system mounted in lead car
113: obstacle detection processing unit of first obstacle detection system mounted in lead car
114: recording unit of first obstacle detection system mounted in lead car
120: second obstacle detection system mounted in tail car
121: external sensor of second obstacle detection system mounted in tail car
122: distribution unit of second obstacle detection system mounted in tail car

123: obstacle detection processing unit of second obstacle detection system mounted in tail car

124: recording unit of second obstacle detection system mounted in tail car

201: train

220: obstacle detection system in train 201

301: ground portion

320: obstacle detection system in ground portion 301

401: ground-vehicle communication

The invention claimed is:

1. An obstacle detection system comprising:

an external sensor configured to monitor surroundings of a train;

two or more obstacle detection processors configured to perform obstacle detection processing for detecting an obstacle by using sensor data acquired by the external sensor, the two or more obstacle detection processors mounted in different cars of the train; and a distributor configured to transmit the sensor data received from the external sensor to at least one of the two or more obstacle detection processors according to sensor information of the sensor data, and to distribute the obstacle detection processing, wherein:

the at least one of the two or more obstacle detection processors perform the obstacle detection processing distributed by the distributor.

2. The obstacle detection system according to claim 1, wherein the distributor distributes the obstacle detection processing to the at least one of the two or more obstacle detection processors according to a magnitude of a sensor data volume of the external sensor.

3. The obstacle detection system according to claim 1, wherein the distributor distributes obstacle detection processing using sensor data of the external sensor to an obstacle detection processor of the two or more obstacle detection processors mounted in a car other than a lead car in a traveling direction.

4. The obstacle detection system according to claim 1, wherein the distributor distributes obstacle detection processing using sensor data of an external sensor in an obstacle detection processor of the two or more obstacle detection processors to another obstacle detection processor of the two or more obstacle detection processors mounted in a car other than a lead car in a traveling direction.

5. The obstacle detection system according to claim 1, wherein the two or more obstacle detection processors are present in a same car of the train.

6. The obstacle detection system according to claim 1, wherein the obstacle detection processing to be distributed to the at least one of the two or more obstacle detection processors is switched according to a traveling direction of the train.

7. The obstacle detection system according to claim 1, wherein the external sensor is a plurality of external sensors whose processing load varies depending on a number of connections, the distributor transmits external sensor data of the external sensors whose processing load varies depending on the number of connections to an obstacle detection processor of the two or more obstacle detection processors provided in a same obstacle detection system as the external sensors.

8. The obstacle detection system according to claim 7, wherein the external sensors whose processing load varies depending on the number of connections are side monitoring external sensors.

9. The obstacle detection system according to claim 1, wherein the distributor distributes the obstacle detection processing to an obstacle detection processor of the two or more obstacle detection processors mounted in another train.

10. The obstacle detection system according to claim 9, wherein the another train is a train having a short communication path with a train in which the obstacle detection system is mounted.

11. The obstacle detection system according to claim 9, wherein the another train is present in a communication path in which a result of the distributed obstacle detection processing is returnable to the obstacle detection system within a constant period.

12. The obstacle detection system according to claim 9, wherein a train that is stopped at a rail yard or a train that is stopped at a station is preferentially set as the another train.

13. The obstacle detection system according to claim 1, further comprising:

the distributor distributes the obstacle detection processing to an obstacle detection processor of the two or more obstacle detection processors present in a ground portion.

14. A railroad vehicle in which the obstacle detection system according to claim 1 is mounted.

15. An obstacle detection system comprising:

an external sensor configured to monitor surroundings of a train; and two or more obstacle detection processors configured to perform obstacle detection processing for detecting an obstacle by using sensor data acquired by the external sensor, the two or more obstacle detection processors comprising at least a first obstacle detection processor and a second obstacle detection processor, the two or more obstacle detection processors mounted in different cars of the train, wherein at least one of the two or more obstacle detection processors perform the obstacle detection processing according to sensor information of the sensor data, and an execution location of the obstacle detection processing, which is distributed to the first obstacle detection processor mounted in a car other than a lead car in a traveling direction and is using sensor data of the external sensor, is switched to the second obstacle detection processor mounted in the lead car according to a change in the traveling direction of the train.

16. An obstacle detection method performed by an obstacle detection system including an external sensor configured to monitor surroundings of a train and two or more obstacle detection processors configured to perform obstacle detection processing for detecting an obstacle by using sensor data acquired by the external sensor comprising:

distributing, using a distributor, the obstacle detection processing to at least one of the two or more obstacle detection processors according to sensor information of the sensor data, wherein the two or more obstacle detection processors mounted in different cars of the train.

* * * * *